US005521610A

United States Patent [19]

Rodal

[11] Patent Number: 5,521,610

[45] Date of Patent: May 28, 1996

[54] CURVED DIPOLE ANTENNA WITH CENTER-POST AMPLIFIER

[75] Inventor: Eric B. Rodal, Cupertino, Calif.

[73] Assignee: Trimble Navigation Limited, Sunnyvale, Calif.

[21] Appl. No.: 429,657

[22] Filed: Apr. 26, 1995

Related U.S. Application Data

[63] Continuation of Ser. No. 123,334, Sep. 17, 1993, abandoned.

[51] Int. Cl.[6] ..... H01Q 1/22; H01Q 21/26

[52] U.S. Cl. ..... 343/797; 343/802

[58] Field of Search ..... 343/797, 795, 343/701, 802, 752; H01Q 1/26, 21/26, 1/22

[56] References Cited

U.S. PATENT DOCUMENTS

| | | | |
|---|---|---|---|
| 3,523,251 | 8/1970 | Halstead | 343/701 |
| 3,701,157 | 10/1972 | Uhrig | 343/797 |
| 3,771,162 | 11/1973 | Dienes | 343/797 |
| 4,633,265 | 12/1986 | Wheeler | 343/797 |
| 5,173,715 | 12/1992 | Rodal et al. | 343/795 |
| 5,198,831 | 3/1993 | Burrell et al. | 343/701 |

*Primary Examiner*—Michael C. Wimer
*Attorney, Agent, or Firm*—Law Offices of Thomas E. Schatzel

[57] ABSTRACT

An antenna system embodiment of the present invention comprises a curved dipole antenna stood off at its center by a printed circuit board assembly containing a pre-amplifier. The curved dipole antenna is implemented with a single-sided flexible circuit and is anchored at its four free ends to a sheet metal base for a groundplane. The printed circuit board assembly containing the predetermined amplifier is fixed perpendicular to the sheet metal base and has a tab that engages a slot in the center of the single-sided flexible circuit for electrical connection of a pair of orthogonal dipoles patterned on one side of the flexible circuit.

12 Claims, 5 Drawing Sheets

CURVED DIPOLE ANTENNA WITH CENTER-POST AMPLIFIER

This is a continuation of application Ser. No. 08/123,334 filed on Sep. 17, 1993 now abandoned.

BACKGROUND OF THE INVENTION

1. Field of the Invention

The invention relates generally to radio antennas and more specifically to omni-directional antennas suited for use with global positioning system receivers.

2. Description of the Prior Art

Separate antennas for global positioning system (GPS) receivers are commonly provided for placement in locations that have clear visibility to orbiting overhead GPS satellites. Such antennas are then cabled to a GPS receiver inside a vehicle.

U.S. Pat. No. 5,173,715, issued Dec. 22, 1992, of which Eric B. Rodal is a co-inventor (Rodal, et al., '715), describes an antenna with curved dipole elements. Such an antenna comprises a base plate that forms a ground plane, a coaxial feed that also serves as a mast perpendicular to the groundplane and that supports the center of two orthogonal dipoles each formed of a pair of elements. The dipoles are implemented on opposite sides of a double-sided flexible printed circuit board.

The signals received by such antennas from orbiting satellites are at such exceedingly low levels that the impedance matching required from an antenna to a coaxial cable and from the coaxial cable to a receiver input, together with the signal losses in the coaxial cable itself, can cause the signal-to-noise ratio to become unacceptably low.

There also exists an intense competitive environment between manufacturers of GPS receiver systems. The manufacturing costs of all the components, the antenna and pre-amplifier included, can significantly influence the number of units that can be sold, because the manufacturing costs set a bottom threshold for pricing strategies.

The antenna described by Rodal, et al., '715 uses a double-sided printed circuit for its antenna elements and a rigid printed circuit board for a groundplane. Such components perform well, but are costly to produce. A less expensive structure to manufacture is needed that can simultaneously address the signal-to-noise ratio problems associated with GPS carrier signal reception.

SUMMARY OF THE PRESENT INVENTION

It is therefore an object of the present invention to provide an omni-directional antenna to receive GPS satellite carrier signals.

It is a further object of the present invention to provide an antenna for receiving GPS satellite carrier signals that is economical to manufacture.

Briefly, an antenna system embodiment of the present invention comprises a curved dipole antenna stood off at its center by a printed circuit board assembly containing a pre-amplifier. The curved dipole antenna is implemented with a single-sided flexible circuit and is anchored at its four free ends to a sheet metal base for a groundplane. The printed circuit board assembly containing the pre-amplifier is fixed perpendicular to the sheet metal base and has a tab that engages a slot in the center of the single-sided flexible circuit for electrical connection of a pair of orthogonal dipoles patterned on one side of the flexible circuit.

An advantage of the present invention is that a GPS antenna system is provided that has substantially reduced manufacturing costs associated with its production.

Another advantage of the present invention is that a GPS antenna system is provided that has improved receiver noise levels.

A further advantage of the present invention is that a GPS antenna system is provided that has a hemispheric reception response.

These and other objects and advantages of the present invention will no doubt become obvious to those of ordinary skill in the art after having read the following detailed description of the preferred embodiment which is illustrated in the drawing figures.

IN THE DRAWINGS

Figure 1:
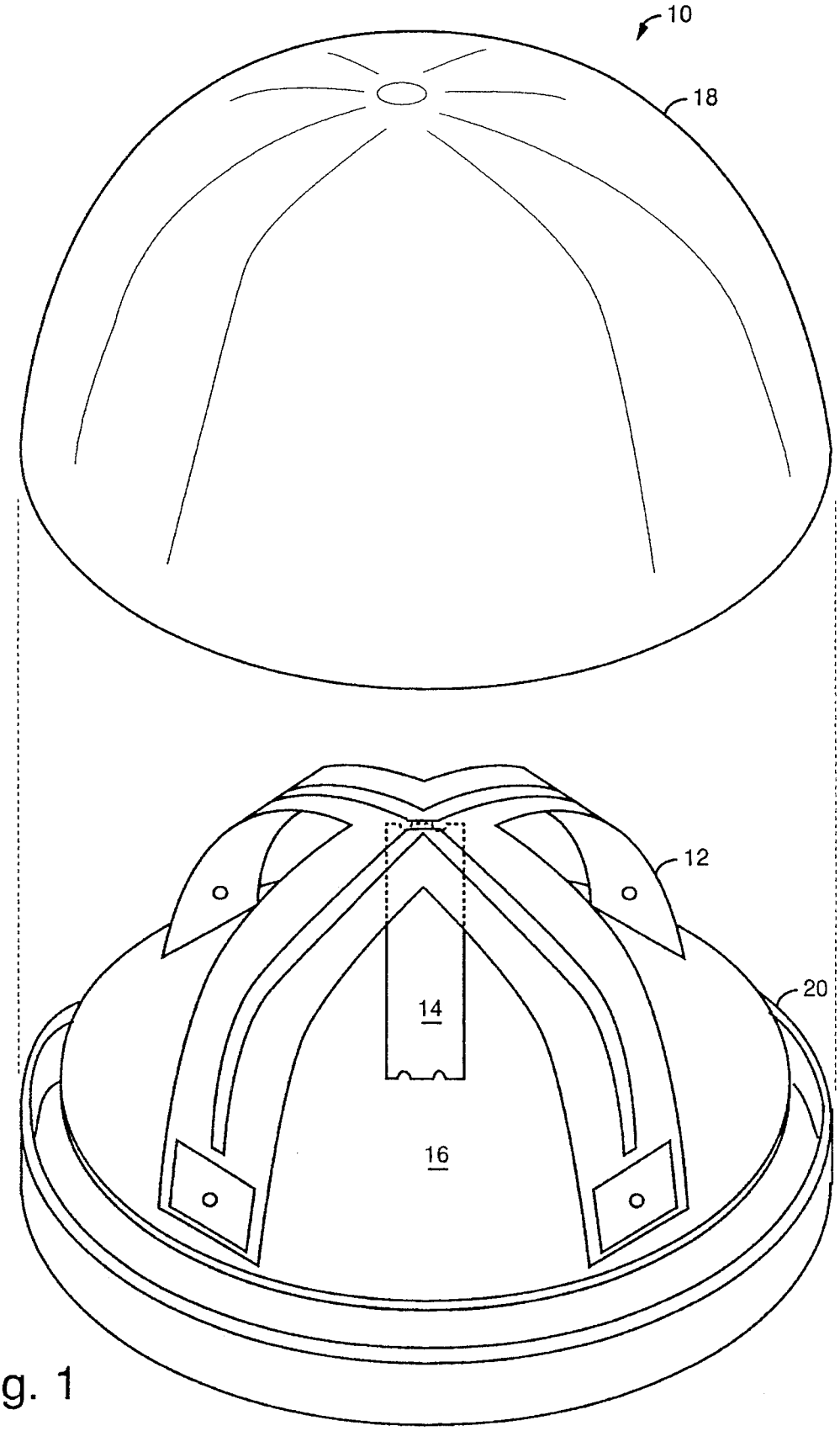
FIG. 1 is a perspective view of an antenna system embodiment of the present invention.
Figure 3:
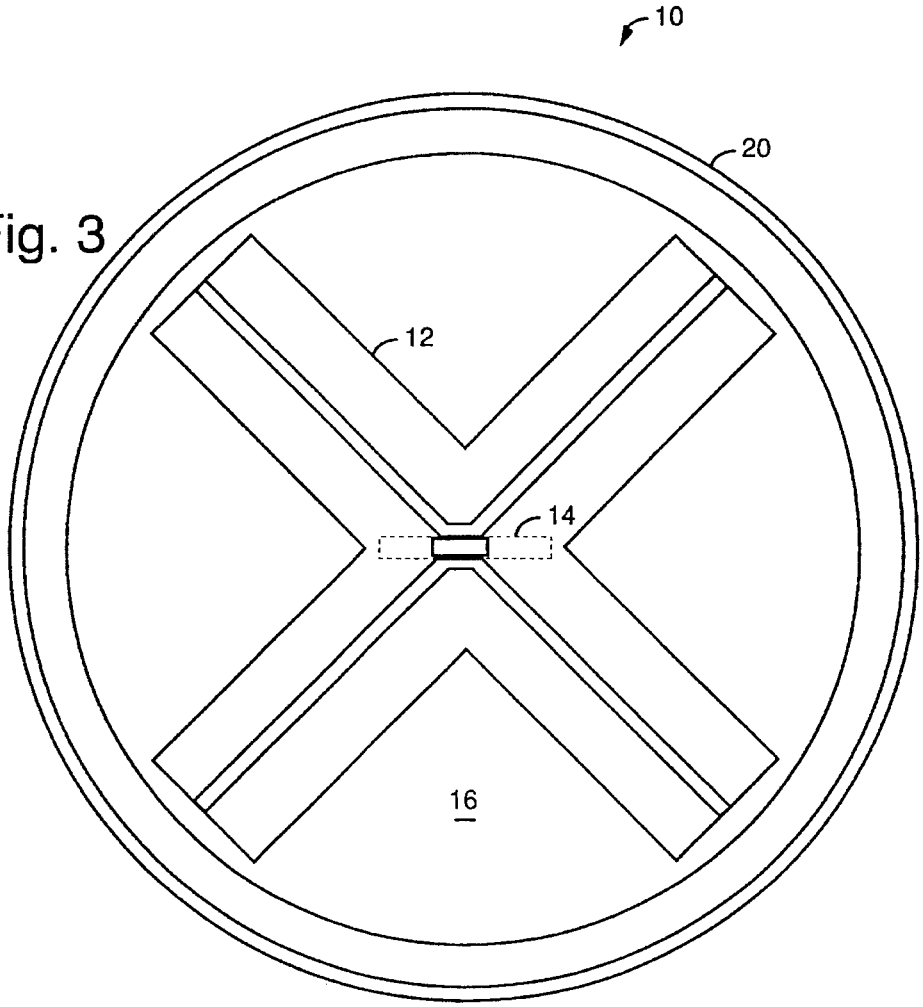
Figure 4:
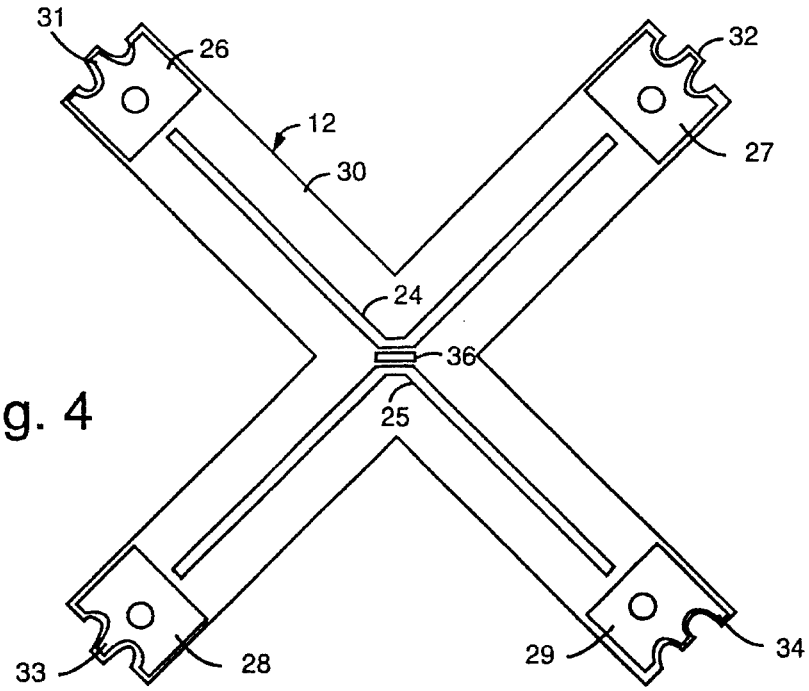
Figure 5:
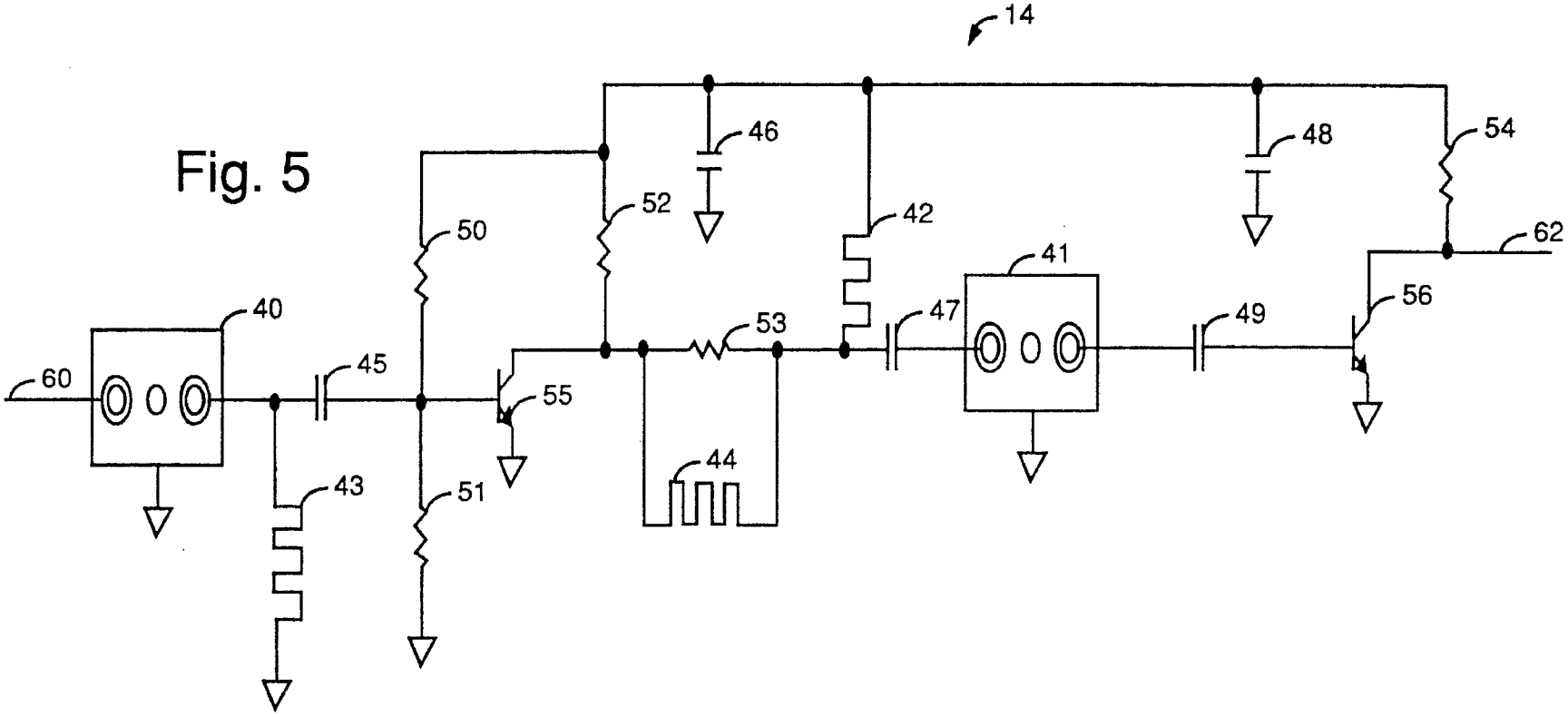
Figure 6:
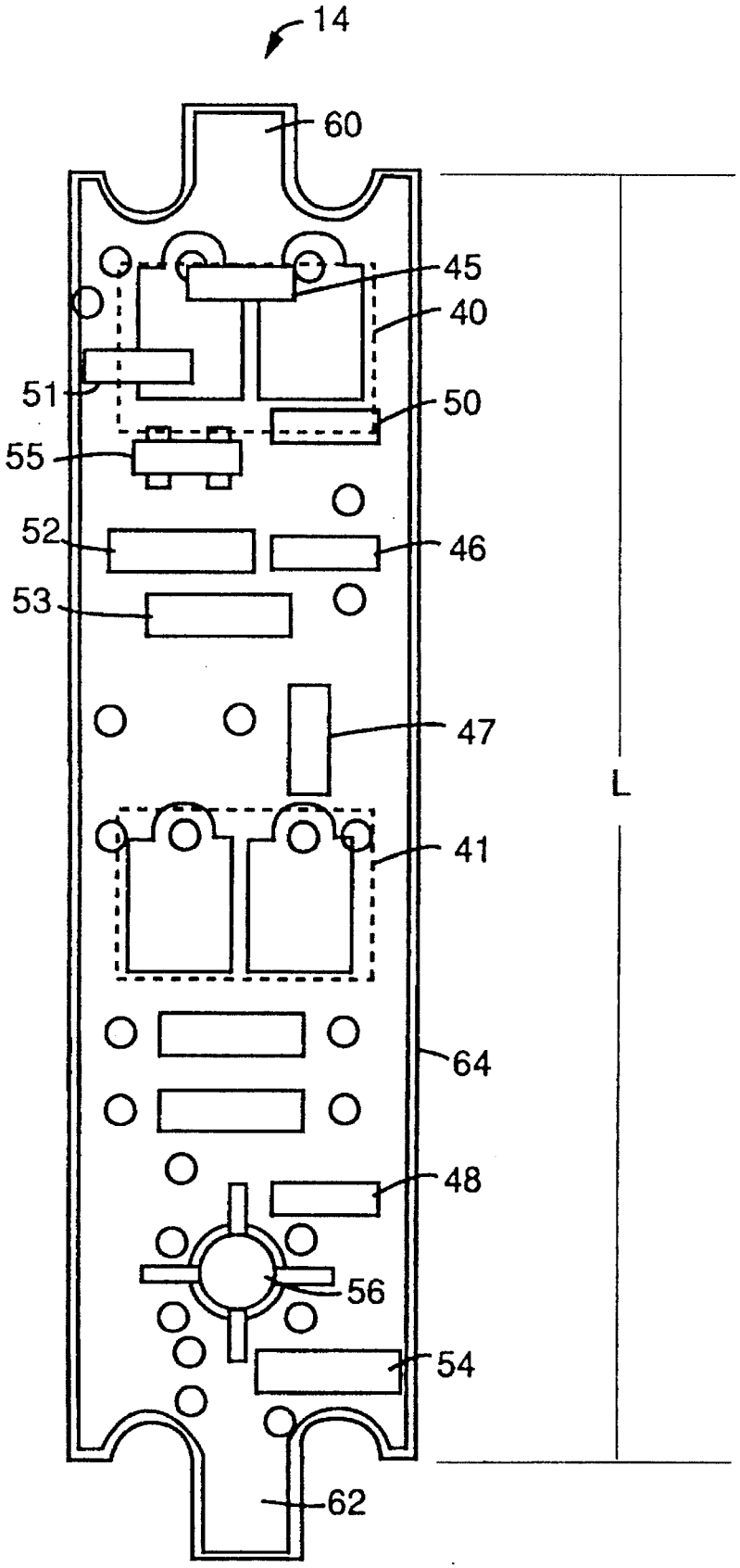

FIG. 3 top view of the antenna system of FIG. 1 shown without the dome;

FIG. 4 is a plan view of a flexible circuit that has a pair of antenna elements as included in the antenna system of FIG. 1;

FIG. 5 is a schematic circuit diagram of a center-post amplifier assembly included in the antenna system of FIG. 1; and FIG. 6 is a plan view of an exemplary printed circuit board layout for the center-post amplifier assembly of FIG. 5.

DETAILED DESCRIPTION OF THE PREFERRED EMBODIMENT

FIG. 1 illustrates a curved antenna system embodiment of the present invention, referred to herein by the general reference numeral 10. System 10 comprises a flexible circuit 12, a center-post amplifier assembly 14, a sheet metal base 16, a non-conductive hemispherical weather dome 18 and a bottom weather housing 20. The dome 18 may comprise a plastic material, e.g., polycarbonate (LEXAN). The dome 18 and bottom housing 20 fit together to enclose flexible circuit 12, center-post amplifier assembly 14 and metal base 16 and protect them from the weather and mechanical injury. The center-post amplifier assembly 14 includes an amplifier circuit generally arranged in a straight line from input at the top to output at the bottom, with respect to FIG. 1.

Figure 2:
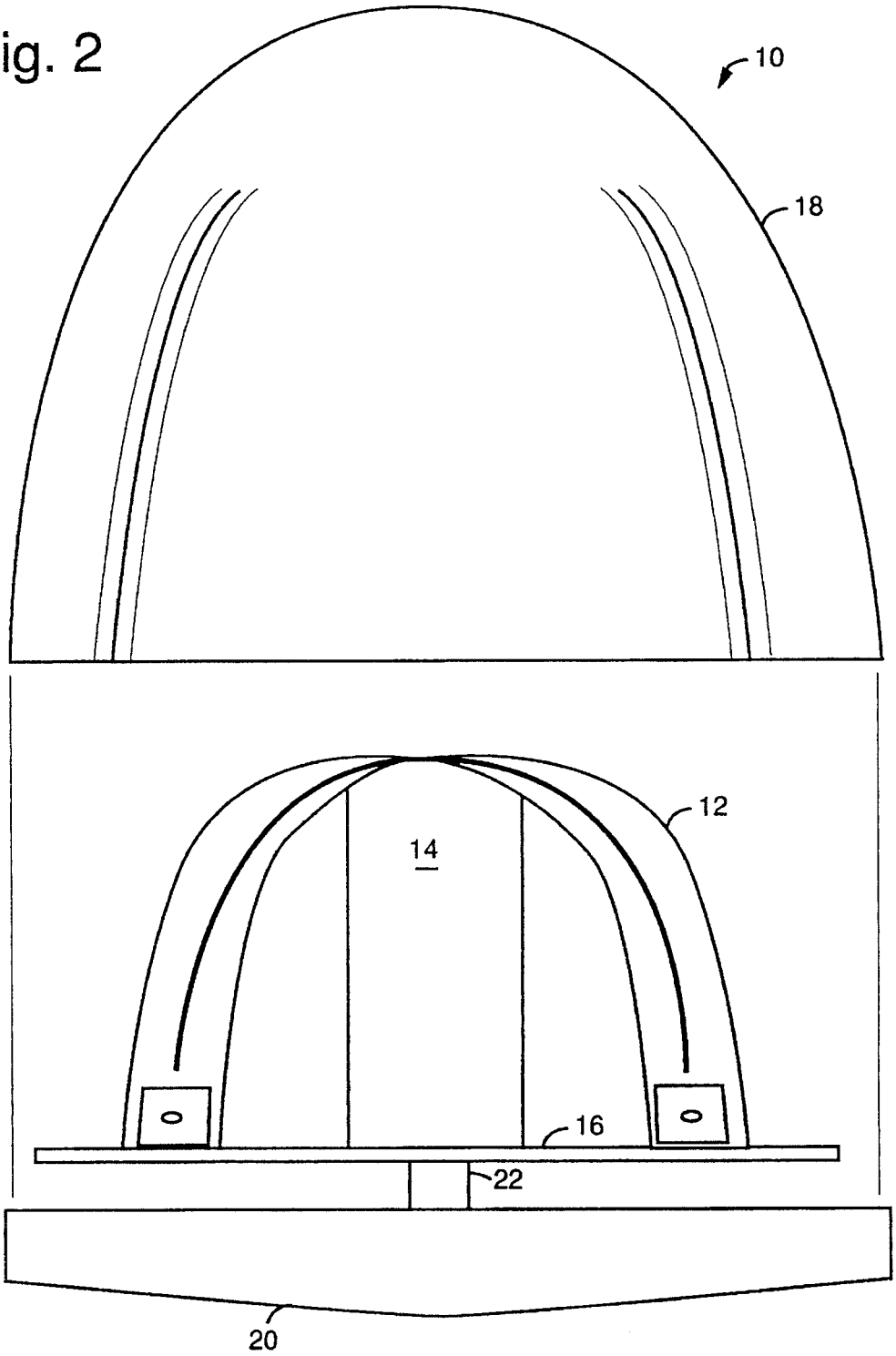
FIG. 2 is a side view of the antenna system of FIG. 1.

FIG. 2 illustrates a side view of antenna system 10. The flexible circuit 12 resembles a flat "X" with its center held aloft from base 16 by amplifier assembly 14 which functions mechanically as a center post. Each of the four petal ends of flexible circuit 12 droop down and are attached to respective points on the perimeter of base 16. The attachment is secured by soldering the pieces together. A stem 22 supports base 16, assembly 14 and flexible circuit 12 within dome 18 and bottom housing 20.

FIG. 3 is a top view of system 10 without dome 18 so that the details of the internal elements can be better demonstrated.

FIG. 4 shows that flexible circuit 12 comprises a pair of printed circuit antenna elements 24 and 25 and a set of four printed circuit anchors 26–29 which are all disposed on one side of an insulating substrate 30. A set of four solder tips 31–34 are respectively provided to anchors 26–29, respectively with a tip 31–34. Each of the tips 31–34 permits grounding of the corresponding anchor 26–29 to base 16 by soldering. The tips 31–33 are located along a centerline of the associated anchor 26–28, while tip 34 is offset to one side of anchor 29 to provide a keying mechanism for orienting assembly 14 and base 16 to flexible circuit assembly 12. Such keying is preferred because it adds a degree of performance consistency from unit-to-unit in manufacturing. A slot 36 permits flexible circuit 12 to be mounted to assembly 14 and for antenna elements 24 and 25 to be soldered to respective points on assembly 14.

Single-sided construction for flexible circuit 12 is preferred because such construction is less expensive to manufacture than double-side printed circuits. The proximity of the ends of antenna elements 24 and 25 to respective grounded anchors 26–29 is such that some capacitive loading results. Preferably, such capacitive loading is controlled and evenly matched wherein an optimum hemispheric reception pattern may be obtained. Antenna elements 24 and 25 form orthogonal dipole antennas that are slightly shorter than one-quarter wavelength at the GPS L1 carrier frequency. Further information regarding the theory of operation, configuration and alternative construction possibilities of the antenna elements, e.g., circuit 12, is included in U.S. Pat. No. 5,173,715, which is incorporated herein by reference.

FIG. 5 illustrates schematically that center-post amplifier assembly 14 is comprised of a pair of ceramic L1-bandpass filters 40 and 41, a pair of radio frequency (RF) chokes 42 and 43 for biasing, an inductor 44, a plurality of capacitors 45–49, a plurality of resistors 50–54, and two transistors 55 and 56 for the required gain. An input 60 and ground accept signals from antenna elements 24 and 25 (FIG. 4) from connection points proximate to slot 36. An output 62 and ground provide a fifty ohm impedance connection that feeds out coaxially through stem 22 (FIG. 2) to a GPS receiver. The output 62 includes less noise and therefore a better signal-to-noise ratio (SNR) than would otherwise be the case if pre-amplification were provided a significant length away from the antenna elements over a coaxial cable. The placement of assembly 14 as a mast to hold aloft circuit 12 is thus critical in its proximity to the antenna elements 24 and 25.

FIG. 6 illustrates a printed circuit board layout for center-post amplifier assembly 14 that has provided good results. A rigid substrate 64 has a groundplane layer seen in FIG. 6 and a signal layer on opposite sides in a double-sided printed circuit board configuration. Input 60 includes a tab that indexes into slot 36. The height that assembly 14 holds aloft the center of circuit 12 from base 16 has an impact on the impedance seen at input 60. A height of just less than one quarter wavelength at L1 GPS carrier frequency provides an acceptable impedance matching between circuit 12 and assembly 14. Fifty ohms is estimated by the present inventor to be a satisfactory value. With reference to assembly 14 shown in FIG. 6, a length "L" of 1.5 inches will be nominal.

Although the present invention has been described in terms of the presently preferred embodiment, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An antenna system, comprising:

a conductive flat planar base including a groundplane comprised of a solid metal and providing for an electrical ground reference;

a pair of curved dipole antennas disposed orthogonal to one another on an X-shaped insulative substrate and mechanically-anchored by respective electrically-open ends to four points just inside a perimeter of the base with the center of said substrate arid dipole antennas separated from the base, wherein the dipole antennas and said substrate comprise a single-sided flexible printed circuit having a slot proximate to said substrate center; and an amplifier assembly completely disposed on a support perpendicular to the base between the center of the base and the center of said substrate and providing for amplification of radio signals provided by a connection to the dipole antennas, wherein the amplifier assembly engages said slot and electrically connects to the dipole antennas.

2. The system of claim 1, wherein:

the dipole antennas further include capacitive loads at respective tips for adjusting a response pattern of the antenna system.

3. The system of claim 2, wherein:

the dipole antennas further include a keying means to orient the base and amplifier assembly to the dipole antennas.

4. The system of claim 1, wherein:

the dipole antennas are separated from the base at their respective centers by approximately one-quarter wavelength of a predetermined operating frequency wherein an impedance match between the dipole antennas and the amplifier assembly is obtained.

5. The system of claim 1, wherein:

the dipole antennas are adapted for use at a nominal center frequency of 1575.42 MHz, wherein carrier signals from global positioning system satellites may be received; and the amplifier assembly supports the dipole antennas at said substrate center aloft from the base by approximately one and one-half inches.

6. The system of claim 1, further comprising:

a non-conductive hemispherical weather dome for enclosing the base, the dipole antennas and the amplifier assembly and comprised of a material substantially transparent to microwave radio signals.

7. An antenna system, comprising:

a conductive flat planar circular base including a groundplane;

a pair of hemispherically-curved dipole antennas disposed orthogonal to one another at their centers on an X-shaped insulative substrate and mechanically-anchored by respective electrically-open ends to four points distributed proximate to a circumference of the base with the center of said substrate and dipole antennas spaced away from the base; and an amplifier assembly completely disposed on a support perpendicular to the base between the center of the base and the center of said substrate and providing for amplification of radio signals provided by a connection to the dipole antennas;

wherein, the base is comprised of a solid metal and provides for an electrical ground reference;

the dipole antennas and said substrate comprise a single-sided flexible printed circuit having a slot proximate to said substrate center; and the amplifier assembly engages said slot and electrically connects to the dipole antennas.

8. The system of claim 7, wherein:

the dipole antennas further include capacitive loads at respective tips for adjusting a response pattern of the antenna system.

9. The system of claim 7, wherein:

the dipole antennas further include a keying means to orient the base and amplifier assembly to the dipole antennas.

10. The system of claim 7, wherein:

the dipole antennas are separated from the base at their respective centers by approximately one-quarter wavelength of a predetermined operating frequency wherein an impedance match between the dipole antennas and the amplifier assembly is obtained.

11. The system of claim 7, wherein:

the dipole antennas are adapted for use at a nominal center frequency of 1575.42 MHz, wherein carrier signals from global positioning system satellites may be received; and the amplifier assembly supports the dipole antennas at said substrate center aloft from the base by approximately one and one-half inches.

12. The system of claim 7, further comprising:

a non-conductive hemispherical weather dome for enclosing the base, the dipole antennas and the amplifier assembly and comprised of a material substantially transparent to microwave radio signals.

* * * * *